US007436877B2

(12) United States Patent
Karlsson

(10) Patent No.: US 7,436,877 B2
(45) Date of Patent: Oct. 14, 2008

(54) METHOD AND APPARATUS TO PERFORM SURGICAL REACTIVE JAMMING WHILE MAINTAINING SIMULTANEOUS TACTICAL COMMUNICATIONS

(75) Inventor: Lars Karlsson, Santa Clara, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 275 days.

(21) Appl. No.: 11/480,706

(22) Filed: Jul. 3, 2006

(65) Prior Publication Data

US 2007/0116093 A1 May 24, 2007

Related U.S. Application Data

(63) Continuation of application No. 10/912,976, filed on Aug. 6, 2004, now Pat. No. 7,126,979.

(60) Provisional application No. 60/696,717, filed on Jul. 5, 2005.

(51) Int. Cl.
*H04B 1/69* (2006.01)
*H04K 3/00* (2006.01)

(52) U.S. Cl. ..... 375/130; 455/1; 342/14

(58) Field of Classification Search ..... 375/130–135, 375/138, 139, 141, 144–146, 295; 455/1; 342/14, 17

See application file for complete search history.

(56) References Cited

U.S. PATENT DOCUMENTS 5,822,429 A * 10/1998 Casabona et al. ..... 380/252
6,232,909 B1 * 5/2001 Masciulli ..... 342/13
6,486,823 B1 * 11/2002 Benson et al. ..... 342/14
2006/0140251 A1 * 6/2006 Brown et al. ..... 375/135

* cited by examiner

*Primary Examiner*—Don N Vo

(57) ABSTRACT

A Method and Apparatus to Perform Surgical Reactive Jamming while Maintaining Simultaneous Tactical Communications is disclosed. The system provides an enhancement to surgical reactive jammers that combines near-real-time jamming capability with the additional feature of allowing tactical communications. The tactical communications transmissions are compressed and packetized such that they can be broken up and transmitted during the jamming system's look-through periods. This approach facilitates listening during these look-through periods (not only for EW emitters, but also for friendly communications signals). The system should allows for talk during these look-through periods ("talk-through" periods). Such a system is unique in that it can automatically calculate the best frequency for a surgical reactive jammer to use against enemy targets as well as providing a fully secure tactical communications link which is synchronized with other units in the field. This invention is therefore vital to the interests of United States national security as it provides a valuable Electronic Warfare capability.

20 Claims, 2 Drawing Sheets

METHOD AND APPARATUS TO PERFORM SURGICAL REACTIVE JAMMING WHILE MAINTAINING SIMULTANEOUS TACTICAL COMMUNICATIONS

This application is a continuation of application Ser. No. 10/912,976, filed Aug. 6, 2004, now U.S. Pat. No. 7,126,979.

This application is filed within one year of, and claims priority to Provisional Application Ser. No. 60/696,717, filed Jul. 5, 2005.

BACKGROUND OF THE INVENTION

1. Field of the Invention

This invention relates generally to electronic warfare and communications systems and, more specifically, to a Method and Apparatus to Perform Surgical Reactive Jamming while Maintaining Simultaneous Tactical Communications.

2. Description of Related Art

Due to the pervasive use of electronic jamming in the modem warfare field, reliably maintaining friendly communications has become increasingly difficult. To date, there has been no other device coupling an enhanced electronic warfare jamming capability to deny enemy communications while simultaneously maintaining a tactical communications link. This capability is essential for mobile surgical reactive jammer units in the field. Such field units typically need to maintain their own secure voice communications ("comms") with other mobile units, or higher echelon commands, for tactical orders, safety considerations, and battlefield coordination. The problem for present day units is that while performing their respective jamming missions, it precludes them from using their own tactical communications links due to the RF interference of having the jamming equipment in such close proximity to the tactical comms equipment. Thus the operating personnel must make a choice between using one or the other at any given time.

What is needed is a system and method that solves that issue and provides a unique capability to perform both surgical reactive jamming and tactical communications simultaneously, in one device, without any interference between the two functions.

The jammer device described by patent application Ser. No. 10/912,976 is sometimes referred to in the Electronic Warfare industry as a "wideband reactive jammer", "surgical follower jammer," or a "surgical reactive jammer" because it has the ability to quickly find enemy signals and then apply energy exactly on target so as to jam those enemy communication signals. This has greatest application against modem military radios that are known as "frequency hoppers". The current world industrial trend today is that these frequency hopper radios are getting faster and faster, which makes them harder to jam and intercept. The faster the hopper radios, the closer they need to be to each other in order to maintain synchronization. Thus this also implies that in the future, jamming equipment will need to be closer to them in order to effectively have enough time to react to those signals. The fact that future electronic warfare jammers will need to be closer to their intended targets means that mobile jammer units will need to become more sophisticated, agile, and stay in constant communications contact with their commanders. The solution is to successfully modify jammer equipment to also perform as a comms system. The advantage is that the power amplifiers and the filters that are already used for jamming operations can be re-used. This greatly reduces the size and weight of such equipment that can perform both jamming and tactical comms.

What is needed therefore in order to feasibly detect and jam modem fast transmissions while at the same time maintain tactical communications is a system that not only has: 1) The near-realtime jamming capability described in the aforementioned previous patent application Ser. No. 10/912,976; 2) The ability to accept analog voice or data for processing and transmission; 3) The ability to receive and distinguish enemy signals from friendly signals, and finally 4) The ability to be precisely synchronized with all other like units in the field in both timing and communications hop sets.

SUMMARY OF THE INVENTION

In light of the aforementioned problems associated with the prior methods and systems, it is an object of the present invention to provide a Method and Apparatus to Perform Surgical Reactive Jamming while Maintaining Simultaneous Tactical Communications. It is an object of the present invention to provide this enhancement to surgical reactive jammers that combines near-real-time jamming capability with the additional feature of allowing tactical communications. The tactical communications transmissions should be compressed and packetized such that they can be broken up and transmitted during the jamming system's look-through periods. This approach should facilitate listening during these look-through periods (not only for EW emitters, but also for friendly communications signals). The system should also allow for talk during these look-through periods ( "talk-through" periods). Such a system would be unique in that it could automatically calculate the best frequency for a surgical reactive jammer to use against enemy targets while also providing a fully secure tactical communications link which is synchronized with other units in the field.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, of which:

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide a Method and Apparatus to Perform Surgical Reactive Jamming while Maintaining Simultaneous Tactical Communications.

Figure 1:
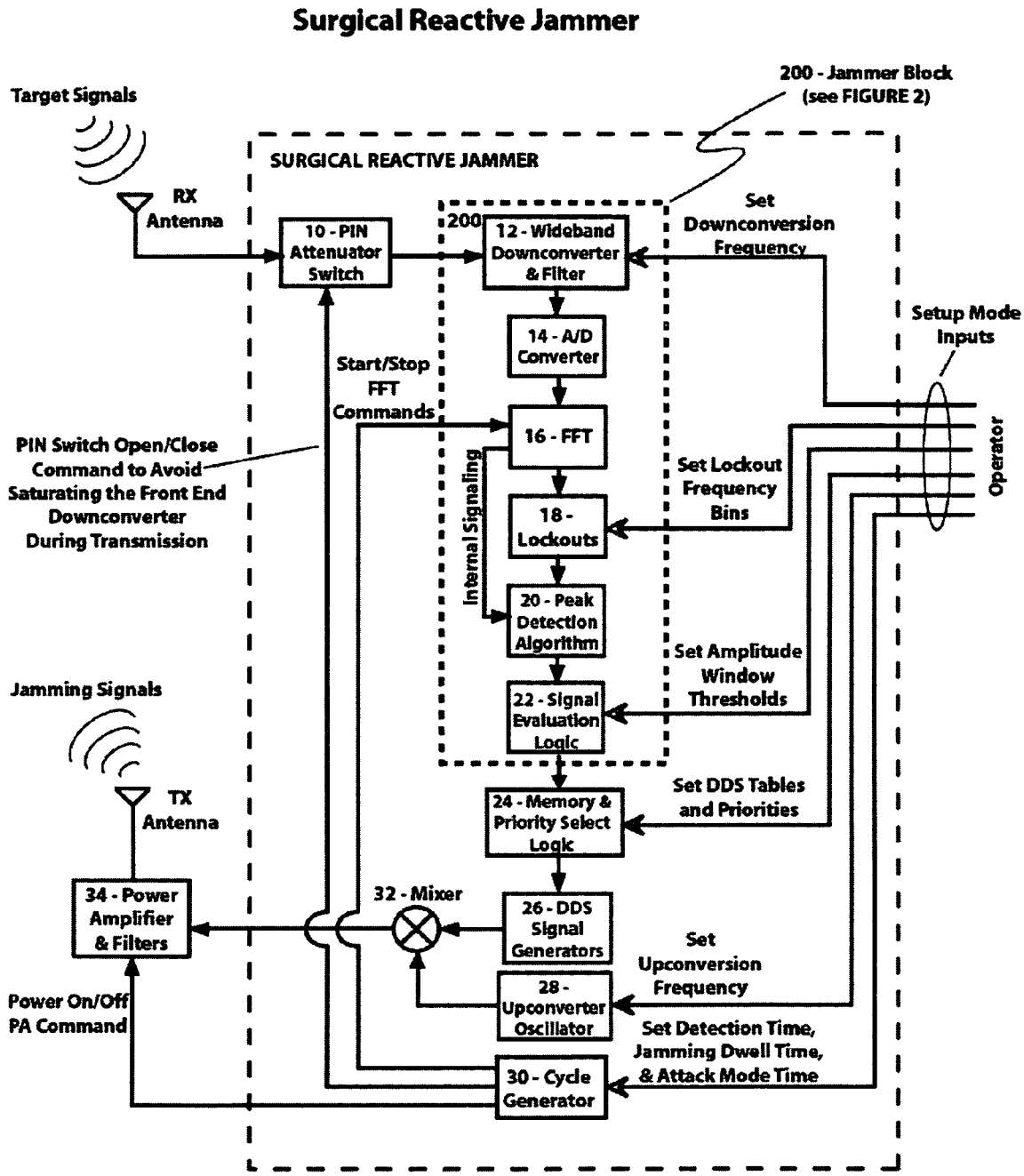
FIG. 1 is a depiction of the Surgical Reactive Jammer System of application Ser. No. 10/912,976.

The present invention can best be understood by initial consideration of FIG. 1. FIG. 1 is a depiction of the Surgical Reactive Jammer System of application Ser. No. 10/912,976. As mentioned, the present invention is an extension and an augmentation to a previously filed U.S. patent application Ser. No. 10/912,976: "System and Method to Autonomously and Selectively Jam Frequency Hopping Signals in Near Real-Time." The disclosure of this parent application will be referenced continually throughout the instant description, and is therefore incorporated herein by reference.

FIG. 1 shows the surgical reactive jammer disclosed in the parent application, provided for reference as the next figure will show the invention's modifications to this block diagram. For simplicity, several of the function modules are grouped together into a "jammer block" so as to reduce the complexity of the following FIG. 2 which shows the invention.

The growing use of fast frequency-hopping radios and push-to-talk radios magnifies the need to have faster and faster electronic warfare jammers to counter them. To address these types of radios and transceivers, the surgical reactive jammer technology of the parent patent application was invented; this technology provides a jamming system that can instantaneously detect the presence of enemy signal energy and then apply signals hyper reactively so as to jam those enemy communication signals. The present invention allows a surgical reactive jammer to also be used simultaneously as a tactical communications system. This capability is critical for future mobile jammer units that need to stay in contact with their upper echelon commanders. This capability greatly enhances the efficiency of a surgical reactive jammer in that it allows personnel to re-use the power amplifier equipment for tactical communications use. Previously an operator had to choose between either using his/her tactical comms equipment or using the jamming equipment, but not both at the same time. This invention solves that problem.

This jammer uses a device that has a wideband front-end which can process the entire intermediate frequency (IF) output at one time. Thus, all the signal information contained within the bandwidth of the IF filter can be analyzed instantly. The resulting IF output may contain one or many short duration communication signals.

The next section contains the selection logic by which it is automatically determined whether or not the received signal should be jammed. The cycle generator section regulates the user configurable System timing. The final section of the surgical reactive jammer executes the jamming frequency generation and output, which must also occur extremely quickly. All of these processes occur in near real time.

The Wideband Downconverter, A/D Converter, FFT, Lockouts, Peak Detection Algorithm, and Signal Evaluation Logic sections of the parent jammer design are not changed in the present invention. Thus for simplicity in drawing the following FIG. 2, those module sections are grouped together and labeled "Jammer Block".

Figure 2:
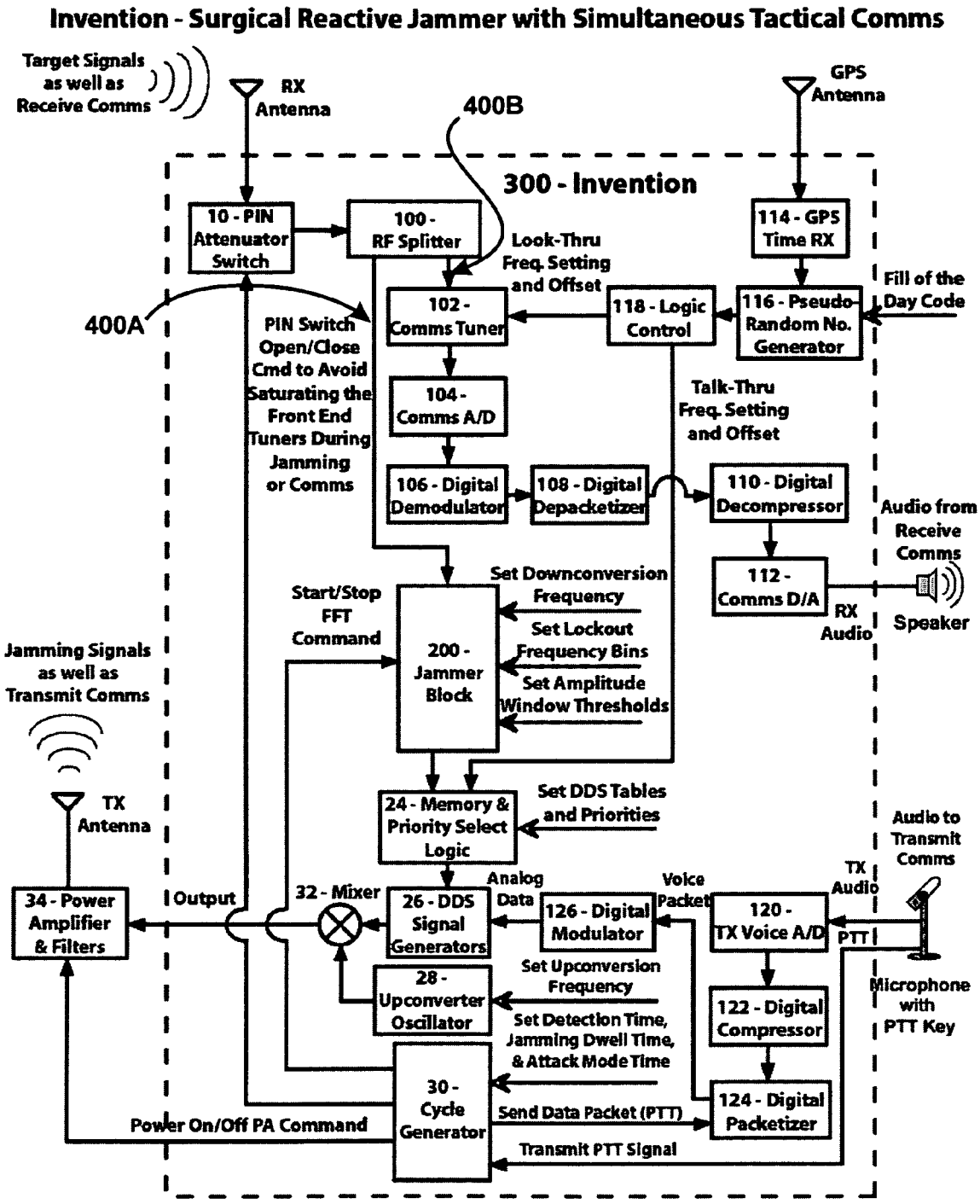
FIG. 2 is a depiction of the System of FIG. 1 further including the Communications Subcircuit System of the present invention.

FIG. 2 is a depiction of the System of FIG. 1 further including the Communications Subcircuit System of the present invention. The invention is comprised of several sections including voice transmission and reception circuitry modules. All functions of the tactical communications are done in near real-time. The surgical reactive jammer function itself is described in detail in the prior patent application and thus will not be discussed here in this disclosure.

An RF splitter 100 is used to split the incoming signals into two fully independent processing paths. As an alternative embodiment of the invention, separate antennas could also be used. The first path 400A is through the Jammer Block 200, which performs all the surgical reactive jamming functions (as disclosed in the parent application). In this path, the signals go through the normal processing to determine whether or not they should be jammed.

The second path 400B is independent and uses it's own fast tuner 102 to pick up the communications burst signals. It then goes through a series of processing steps to digitize 104, demodulate 106, depacketize 108, and decompress 110 the data before delivering clean audio to the operator (after converting to analog data 112).

The tuner 102 is continually programmed to the correct frequency by a logic control section 118. This logic control section 118 takes its inputs from a conventional pseudo-random number generator 116, which when programmed with a code of the day, will give the unique "hop-set" of frequency channels where the friendly communications will operate.

The transmission side of things takes in (audio, for example) through a microphone interface and performs digitization 120, compression 122, packetization 124, and modulation 126. The resultant modulated data burst is then fed to one of the DDS's in the DDS Signal Generator section 26, where it is mixed and then sent out through the regular output chain.

All of these functions above are described in more detail in the following Operation section of this provisional patent application.

DIAGRAM REFERENCE NUMERALS

10 PIN Diode Attenuator Switch
12 Wideband Downconverter and Filters
14 Analog-to-Digital Converter (A/D)
16 Fast Fourier Transformations (FFT's)
18 Lockout Logic
20 Peak Detection Algorithm
22 Signal Evaluation Algorithm
24 Memory and Priority Select Logic
26 Direct Digital Synthesizer (DDS) Signal Generators
28 Upconverter Oscillator
30 Cycle Generator
32 Mixer
34 High Power Amplifier (PA) and Output Filter
100 RF Splitter
102 Communications Tuner
104 Comms A/D Converter
106 Digital Demodulator
108 Digital Depacketizer
110 Digital Decompressor
112 Comms D/A Converter
114 GPS Time Receiver
116 Pseudo-Random Number Generator
118 Logic Control
120 TX Audio A/D Converter
122 Digital Compressor
124 Digital Packetizer
126 Digital Modulator
200 Jammer Block
300 System of the Present Invention Operation The operation of the invention is described herein. It is assumed that the reader is already familiar with how the surgical reactive jammer works (minus the enhancement of this invention) by reading the aforementioned patent application Ser. No. 10/912,976. Most of the details regarding this prior art will not be discussed here. Rather the discussion in this document will focus on the invention at hand which is an augmentation to the parent system.

As before, a wideband digital reception technique is used to instantaneously detect the presence of enemy signal energy within large bands of RF spectrum. Detection of signals occur on cyclical "look-through's" which are short time periods whereby the jammer does not radiate so as to allow the wideband front end tuner to have the sensitivity to pick up any newly occurring signals. Once this look-through period is complete, the jammer emits energy once more until the next look-through period commences. This "attack cycle" repeats itself indefinitely during jamming operations.

The technique of this patent application will exploit these look-through periods in order to receive and send secure comms traffic at those very times. Thus, when an operator wants to use voice communications, the comms information will be packaged and sent during the time periods when the look-throughs would occur. To differentiate what happens functionally during this period, a "look-through" process is hereby defined as the act of collecting spectrum information searching for new target signals. But when this same time period is instead used to send out a packet of compressed data, then the "look through" time period can more accurately referred to as a "talk-through" time period. It is important for the reader to note that the same physical period of time can be called either a look-through or a talk-through period, the designation of which depends on what function is employed during that cyclical time period by the invention.

During a look-through, enemy signals as well as friendly communications signals are "listened for" simultaneously. During a talk-through, neither of those signals are received anymore as the time period is instead used to transmit friendly communications signals.

To begin with, signals come in through the receive antenna (RX antenna) and are passed through the PIN attenuator switch 10. This switch is only closed when a look-through or talk-through period is active. When closed, incoming signals through the PIN switch 10 are split equally by an RF splitter 100.

One path of the incoming signals 400A leads to jammer block 200, which contains the sub-modules shown in FIG. 1. The processing of this path is identical to that of the previous patent application for the surgical reactive jammer. As mentioned earlier, since there are no changes to the jamming functionality, the processing details will not be covered again in this document.

The second path of the incoming signals 400B leads to new additional hardware modules. A communications tuner 102 also receives the incoming signals but only tunes to the exact frequency location where a friendly communications signal would be transmitting at that moment. It "listens" on this particular frequency for the entirety of that respective look-through period. The tuning control of this tuner 102 is performed by another set of synchronizing hardware, which will be discussed later in this document.

Continuing, the tuner 102 outputs its IF to a comms A/D converter 104, which then digitizes the received signal. The digitized IF then goes to a digital demodulator 106 which demodulates the signal. The output result is a packetized and compressed datastream. This datastream then goes to a digital depacketizer 108 which unravels the packaging and outputs a compressed datastream. The compressed datastream then goes to a digital decompressor 110 which, as the name implies, decompresses the data so that a clean digital stream of audio samples (for example) comes out. These audio samples then go to a communications D/A converter 112 where the digitized audio is converted back again to simple audio and the voice is output to an external (or internal) speaker.

It is important to note that the audio data that is received every look-through period is delivered as discrete packets of compressed data. The reason for this is that the individual look-through and talk-through periods are non-contiguous, since they are cyclically interrupted by the normal jamming operations. The packetization is necessary to get the right amount of data into the invention 300 every look-through period. The compression is necessary so that no voice or data information is lost once the packets are put back together. To the operator listening to the speaker output, the received friendly communications will appear as clean, uninterrupted voice. The process above is transparent to the operators.

Synchronization is very important for this invention 300 because the tactical communications are frequency hopping, and thus each unit must be in synchronization to receive those signals. Synchronization is achieved through the following steps. First, a GPS time receiver 114 is a part of each invention 300. The GPS time receiver outputs its time information into a pseudo-random number generator 116. The pseudo-random number generator 1 16 also takes in a "fill-of-the-day" key code string. This key code string contains a starting frequency number as well as secret "seed" number.

With these two entries (the GPS time stamp and the fill-of-the-day code), an algorithm within the pseudo-random number generator 116 will calculate an offset value from the starting frequency number. This offset value will change depending on the GPS time stamp that is entered at any particular time. The resulting final "communication hop frequency" value is the start frequency (from the fill-of-the-day code) plus the offset. This communication hop frequency is then sent to the logic control module 118. Logic control 118 takes in that particular hop frequency value and sends the proper commands over to the communications tuner 102 to go to that setting, at that moment in time.

As the reader can see, this couples the frequency hopping pattern of all inventions 300 in the field as long as they all have the same fill-of-the-day key code entered into the system. All inventions 300 will thus listen on the right frequencies at the precise moments in time. The same frequency hopping pattern is used for the transmission of tactical communications, which is described below.

To transmit voice, the operator speaks into a microphone with a typical push-to-talk (PTT) key. The audio goes to the TX audio A/D converter 120 where it gets sampled. The sampled audio stream then goes to the digital compressor 122, which "squeezes" the samples together with a compression ratio that is identical to the ratio between the length of the talk-through period divided into the length of a full attack cycle. From the digital compressor 122 the compressed stream then goes to the digital packetizer 124. This packetizer module 124 has to break up the compressed stream into appropriate size "chunks" so that they can be transmitted in bursts, one chunk per talk-through period.

The microphones PTT signal is sent to the cycle generator 30, which coordinates all the timing of the invention 300. When receiving a PTT signal, the cycle generator 30 detects that the operator wants to transmit voice. A signal is then sent to the digital packetizer 124 to release the latest packet to the digital modulator 126. The cycle generator 30 also sends the proper commands to the PIN attenuator switch 10 to avoid saturating the communications tuner 102 or the wideband tuner 12. The digital modulator 126 then sends its analog data over to one of the DDS's in the DDS signal generator module 26.

The logic control module 118 that provides the communications hop frequency, also provides that exact same value to the memory & priority select logic module 24. This module 24 properly programs the output frequencies values into one of the direct digital synthesizer (DDS) signal generators 26 so that those frequencies can be generated. When the actual data arrives to one of the DDS's inside the DDS signal generator module 26, it is mixed and sent out on the communications hop frequency carrier wave.

Thus, when the invention 300 is transmitting tactical voice communications on a talk-through, there is no receiving of new signal information during that period. That means that the invention 300 will maintain it's last known jammer programming for the initial jamming that commences immediately after the talk-through period ends. The surgical reactive jamming operation is thus generally unaffected by the action of sending tactical communications because the voice data is only sent during a talk-though period when the operator presses the PTT key on the microphone. Otherwise, the invention 300 is simply listening for traffic on the communications hop frequencies every look-through period.

In conclusion, this invention allows the jammer to compress the TX data packets and then burst them out, one at a time, at some or every talk-through period. As an alternate embodiment of the invention, the data packets can be sent out on every other period, thus interchanging look-though periods and talk-through periods. On the jamming side, the invention will be tuned and listening to that particular synchronized frequency hop. The invention will take in the compressed data burst for processing and demodulation. In this way, the jammer can continue its mission while at the same time functioning as a tactical communications system. This expanded functionality will lead to significantly less fratricide in the field and offer the unique ability to jam while maintaining communications with the same equipment. In addition, the resulting tactical communications will be very hard to intercept and decode by opponents, since they will not only be frequency hopping, but they are also modulated, compressed, and packetized.

Furthermore, it will be extremely difficult for enemies to jam these tactical communications signals, because the invention's normal jamming signals (which do not contain any tactical comms data) will essentially become decoy signals for the real tactical communications hops. It is also worth noting that because of the extremely short data bursts it is almost impossible to intercept and then apply jamming before one burst ends and the comms transmit frequency has changed.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A combination electronic jamming and voice communication system, comprising:

antennae means for receiving incident RF signals;

an RF splitter for splitting said incident RF signals into a jamming system input data stream and a communication system input data stream;

a cooperating communications system, comprising:

a communications receive module for receiving said communication system input data stream and converting it to an operator output data stream if said communication system input data stream is on a predetermined frequency; and a communications transmit module for transmitting outgoing operator data streams; and an electronic signal jamming system, comprising:

a wideband signal collection front end receiving said jamming system input data stream; and a signal evaluation logic module;

an internal transmitter also responsive to said signal evaluation logic module for transmitting a jamming signal on a frequency of interest determined by said signal evaluation logic module;

and an internal cycle generator timing circuit for the proper high-speed automatic triggering of all modules of the said electronic signal jamming system and said cooperating communications system.

2. The combination of claim 1, wherein:

said electronic signal jamming system operatively defines lookthrough periods and attack periods; and said cooperating communications system operatively receives or transmits only during said lookthrough periods.

3. The combination of claim 2, further comprising switch means for interrupting the flow of said incident RF signals to said RF splitter during said lookthrough periods.

4. The combination of claim 3, wherein said communications receive module comprises:

a tuner tuned to said predetermined frequency, said tuner receiving said communication system input data stream;

a digitizer for digitizing said portion of said communication system input data stream at said predetermined frequency;

a demodulator for demodulating said digitized communication system input data stream;

a depacketizer for uppacking said demodulated communication system input data stream;

a decompressor for decompressing said depacketized communication system input data stream;

an analog converter for converting said decompressed communication system input data stream into analog data; and output means for outputting said analog data.

5. The combination of claim 4, wherein said electronic signal jamming system further comprises:

said wideband signal collection front end having a wideband receiver for receiving RF signals across a broad spectrum, a digitizer for creating a continuous stream of digitized data representing said received RF signals, and a digital data conversion means for converting said digitized data into FFT frequency bins;

and said signal evaluation logic module having a comparing means for comparing each said frequency bin to configurable preset lockout frequency bins, a peak detection means for evaluating and calculating the amplitude value for each bin by using a configurable number of data point samples for each of those bins, a windowing means for evaluating and calculating the amplitude value for each bin by using a configurable number of data point samples for each of those bins, and a priority selection means for evaluating the prioritization of jammer signal targets based upon configurable settings;

and an internal transmitter also responsive to said comparing, peak detection, windowing, and priority logic for transmitting a jamming signal on a frequency of interest.

6. The combination of claim 5, wherein said digital data conversion means comprises means for converting said digitized data from a time domain to a frequency domain.

7. The combination of claim 6, wherein said digital data conversion means comprises means for converting said frequency domain converted data from separate real and imaginary components to normalized amplitude data.

8. The combination of claim 7, wherein said normalized amplitude data is categorized by frequency bins.

9. The combination of claim 8, wherein said comparing means comprises comparing data in said frequency bins to frequency lockouts.

10. The combination of claim 9, further comprising peak detection means for evaluating the amplitude of said frequency bins.

11. The combination of claim 10, wherein said windowing means for evaluating each bin to be within configurable amplitude bound limits.

12. The combination of claim 11, further comprising means for comparing said amplitude-evaluated signal to a pre-established signal priority list.

13. The combination of claim 12, wherein said signal priority logic means further compares said amplitude-evaluated signal to a real-time priority request.

14. A method for jamming RF signal transmissions while conducting RF communications, comprising the steps of:

detecting an analog RF signal transmission;

splitting said analog RF signal transmission into a jamming system RF (JSRF) signal and a communications system RF (CSRF) signal;

executing a jamming method, said jamming method comprising the steps of:

digitizing said detected JSRF signal;

converting said digitized JSRF signal into frequency bins;

comparing said frequency bins to configurable lockout frequency bins;

evaluating and calculating the amplitude value for each said bin by using a configurable number of data point samples for each of those bins;

evaluating the prioritization of jammer signal targets based upon configurable settings;

triggering said start of the conversion of said digitized signals into said frequency bins;

triggering the end of the conversion of said digitized signals into said frequency bins;

triggering the release of frequency bin information at the correct time;

triggering of the external power amplifier at the correct time to prepare for jammer signals; and automatic programming of a digital signal generator to generate a jamming signal, said signal generator triggering responsive to said comparing; and independent of said jamming method, executing a communications method comprising the steps of:

tuning a tuner to a preset receive frequency;

digitizing any of said CSRF signal at said receive frequency;

demodulating said digitized CSRF signal;

depacketizing said demodulated CSRF signal;

decompressing said depacketized CSRF signal;

converting said decompressed CSRF signal into an analog data stream; and outputting said analog data stream.

15. The method of claim 14, wherein said communications method and said jamming method operate cooperatively, whereby said communications method is executed only when said jamming method is in a standby mode.

16. The method of claim 15, wherein said jamming method further comprises an attenuator switching step, responsive to said digital signal generator, wherein an attenuator switch means for shielding the RF receiver system performing said receiving step is actuated.

17. The method of claim 16, wherein said jamming method further comprises the proper triggering of all internal and external elements of the electronic jamming system.

18. The method of claim 17, wherein said jamming method further comprises a lockout step prior to said comparing step, said lockout step comprising comparing said converted digitized signals to a dynamic list of lockout frequency bins.

19. The method of claim 18, wherein said jamming method further comprises a signal threshold-comparing step prior to said comparing step, comprising comparing said frequency bins to signal threshold settings.

20. The method of claim 19, wherein digital transmitter triggering step is responsive to said signal threshold-comparing step.

* * * * *